United States Patent [19]

Takehana et al.

[11] Patent Number: 4,856,691

[45] Date of Patent: Aug. 15, 1989

[54] YARN GUIDE DEVICE

[75] Inventors: Tatsuo Takehana; Fumio Matsuda, both of Ishikawa, Japan

[73] Assignee: Tsudakoma Corp., Ishikawa, Japan

[21] Appl. No.: 168,656

[22] Filed: Mar. 16, 1988

[30] Foreign Application Priority Data

Mar. 16, 1987 [JP] Japan ..... 62-062290
Aug. 26, 1987 [JP] Japan ..... 62-212336

[51] Int. Cl.[4] ..... B65H 51/16; D03D 47/30; D03D 47/34; D04B 15/48

[52] U.S. Cl. ..... 226/91; 57/279; 139/450; 139/452; 226/7; 226/97

[58] Field of Search ..... 226/7, 91, 97; 57/279, 57/280, 350; 139/450, 452

[56] References Cited

U.S. PATENT DOCUMENTS 3,452,910 7/1969 Richter ..... 226/91
3,605,396 9/1971 Guignard et al. ..... 57/279
3,813,900 6/1974 Cook et al. ..... 226/97 X
3,826,073 7/1974 Hoeber et al. ..... 57/279 X
3,936,997 2/1976 Marzoli ..... 57/279
3,970,231 7/1976 Strutz et al. ..... 226/91 X
4,168,605 9/1979 D'Agnolo ..... 57/279
4,287,712 9/1981 Franzen ..... 57/279
4,355,500 10/1982 Yanobu et al. ..... 57/279
4,658,866 4/1987 Takegawa ..... 139/450

*Primary Examiner*—John Petrakes
*Attorney, Agent, or Firm*—Wenderoth, Lind & Ponack

[57] ABSTRACT

A new weft yarn is supplied to a predetermined position in case when the weft yarn in a control unit, particularly in a loom, is broken. Conventionally, the supply of the new weft yarn is effected by a weaver. The present invention provides a yarn guide device for positioning, holding, and transferring a yarn to a predetermined position. The yarn in then drawn inside of a guide tube located in a predetermined position, and thereafter the yarn is automatically guided to a required device such as a measuring and storing device for the weft yarn.

16 Claims, 7 Drawing Sheets

YARN GUIDE DEVICE

BACKGROUND OF THE INVENTION

1. Field of the Invention:

The present invention relates to a yarn guide device for positioning, holding, and transferring the yarn, and drawing and guiding the yarn to a predetermined position. 2. Prior Art:

A prior yarn guide device is disclosed in Japanese Laid-Open Patent Publication No. 61-47849 (corresponding to U.S. Pat. No. 4,658,866, and European Patent application No. 85109853.3). The prior yarn guide device discloses that an end of a yarn from a new package is drawn into a guide tube by air under suction for guiding the yarn from the new yarn package into a measuring and storing device when the yarn is broken. According to this prior method, there arises such problems that firstly, the end of the yarn is unstably sucked into the guide tube, secondly, a resistance generated to pull out (unwind) the yarn from the outer periphery of the yarn package becomes greater than a force to hold the yarn by air friction generated by an air flow under suction inside the guide tube when the end of the yarn pulled out from the new yarn package is drawn into the guide tube and returned to the original position whereby the end of the yarn is come out from the guide tube.

To prevent these problems, the suction force is intensified and the air frictional force to clamp the yarn in the guide tube is increased. However, a stable yarn guide can not be achieved since there occur such phenomena that the end of the yarn drawn into the yarn guide is twistedly returned, as a result, the yarn is broken so that the end of the yarn is come out from the guide tube.

SUMMARY OF THE INVENTION

Accordingly, it is an object of the present invention to provide an automatic stable yarn guide. Such as a yarn insertion in the manner of tranferring the yarn located in a waiting position, drawing the yarn into the guide tube, and guiding the yarn into a predetermined position so that the yarn is pulled out from a first yarn package from which the yarn is pulled out intrinsically with a relatively high resistance, and the end of the yarn is drawn into a guide tube.

To achieve the object, the present invention has the end of the yarn sealed from the outside when the end of the yarn is drawn into a guide tube, or the end of the yarn is mechanically pushed toward the guide tube, or the end of the yarn located at a waiting position is clamped by a pair of holding members provided at the movable side of a guide member of the guide tube. When the end of the yarn is drawn into the guide tube, a tranferring flow (drawing flow) of air is intensified, and the length of yarn exposed to the transferring flow becomes greater, so that the end of the yarn is drawn into the guide tube with ease. When the yarn is pulled out from the yarn package, the end of the yarn is mechanically held and pulled out toward the pulling side, so that the yarn is pulled out with certainty even if the resistance to pull out the yarn is great.

The above and other objects, features and advantages of the present invention will become more apparent from the following description when taken in conjunction with the accompanying drawings.

PREFERRED EMBODIMENT OF THE PRESENT INVENTION

Figure 1:
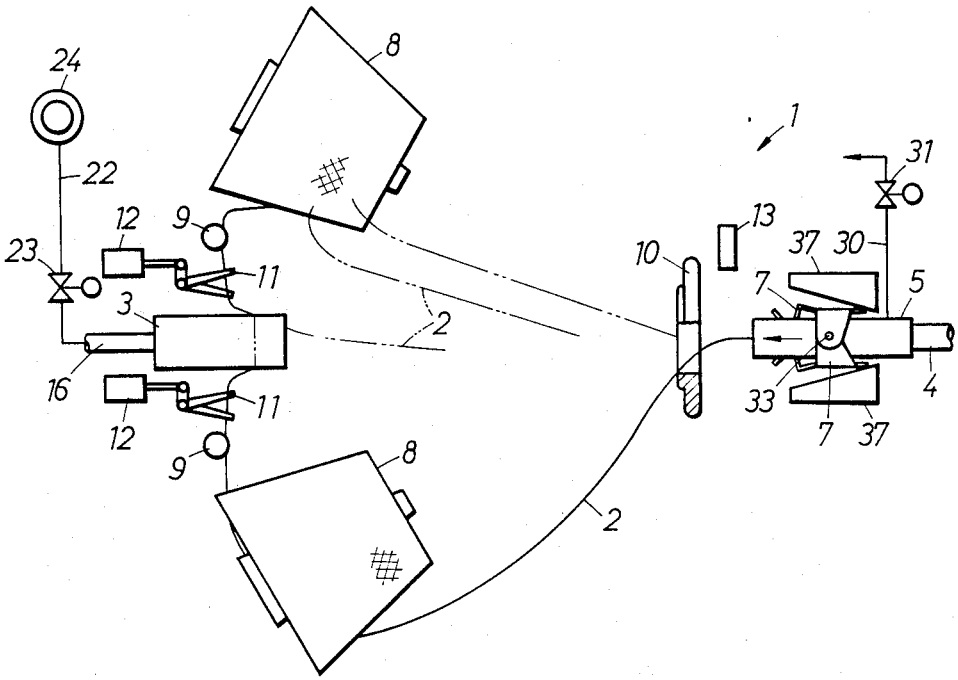
FIG. 1 is a plan view of a yarn guide device of a first embodiment according to the present invention.

In FIGS. 1 to 20 illustrating eighth embodiments of the present invention, similar reference numerals designate similar parts throughout the drawings.

FIRST EMBODIMENT

FIGS. 1 to 5 show a fundamental yarn guide device in a preferred embodiment according to the present invention.

A yarn guide device 1 comprises a guide member 3, fixedly provided at a waiting position of a yarn 2, to be guided in a manner to cross the yarn 2, and a guide tube 4 retractable relative to the guide member 3 at a position opposite to and a predetermined distance from the guide member 3 for drawing the transferred yarn 2 inside thereof and guiding the yarn 2 into a predetermined position. The guide tube 4 has at its inlet portion an engaging member 5 which is provided with an air jet nozzle 6 for at the inside thereof and a pair of clamping members 7 at the outside thereof.

According to the first embodiment, the yarns 2 are weft yarns which are supplied by two yarn packages, and connected with each other at the beginning of winding around one package and at the end of winding around the other package, forming a so called transfer tail, and positioned at the tip end of the guide member 3 located between clampers 9 while the yarns 2 are clamped by the clampers 9. The yarns 2 led from the packages 8 passthrough a large hole of a yarn guide 10, and are guided into the guide tube 4 via the engaging member 5, and finally guided into a predetermined position, namely, into a measuring and storing device (not shown). The yarn 2 can be cut off at need by cutters 11, cylinders 12 driving the cutters 11 being provided on both sides of the guide member 3. The presence of the yarn 2, namely, a state where the yarn is not broken, is detected, for example, by a photoelectric sensor 13 while the yarn 2 passes between the yarn guide 10 and the engaging member 4.

The guide member 3 is cylindrical as a whole as shown in FIGS. 2 to 5. The guide member 3 includes a V-shaped holding groove 14 at the tip end thereof, a tapered hole 15 tapered increasingly from the holding groove 14 toward the inlet portion thereof, and a chamber having a stopper 18, a tail stopper 20 and a spring 19. The guide member 3 houses a part of a hollow inserter 16 having a stopper 17 slidable on its outer periphery inside the guide member 3 and urged by the spring 19 between the stopper 17 of the inserter 16 and the stopper 18 of the guide member 3 in the forward movement direction.

Forward and backward movement of the guide member 3 is restricted by contact the stopper 17 with the tail stopper 20 provided inside the guide member 3 and the stopper 17 with a step 21 of the guide member 3. The inserter 16 is increasingly tapered at its tip end and has a slit 26 on a tapered portion 25. A bottom portion of the slit 26 is in parallel with the tapered portion 25. A rear end of the inserter 16 is fixedly mounted on a frame of the loom, etc. and connected to a source of air under pressure 24 via a pipe 22 and, an electromagnetic closing valve 23.

The engaging member 5 is also cylindrical as a whole, similar to member 3, and is fixed to a tip end of the guide tube 4 at a fit portion 27: It has a cylindrical nozzle 28, the inner diameter of which is decreasingly tapered from the guide member 3 toward the guide tube 4, and a nozzle 6 coaxially arranged with the needle 28. The nozzle 6 has a gap relative to the tip end opening of the needle 28, and is connected to a source of air under pressure 24 via a port 29 defined in the engaging member 5, a pipe 30, and an electromagnetic closing valve 31.

A pair of clamping members 7 are respectively rotatably supported by supporting pins 33 relative to the engaging member 5, and urged by a coil spring 35 at the rear end piece 24 thereof in the direction closing the tip end thereof. The clamping members 7 are inserted into the engaging member 5 from a longitudinal hole 36 defined in the tip end of the engaging member 5, and the clamping members 7 contact each other at holding tongues 32 of the tip end of the clamping members 7. The rear end pieces 34 of the clamping members 7 are arranged oppositely to hit wedged cams 37 fixed to the frame of the loom at the retracted position or backward movement position of the engaging member 5.

The yarn 2 is pulled out from one of the yarn packages 8 as shown in solid line in FIG. 1, passed inside the guide tube 4, measured by a measruing and storing device, and thereafter inserted into a shed of a warp yarn by a picking nozzle, etc. Provided that the yarn 2 is not broken during the sequential operation mentioned just above, a sensor 13 does not issue a stop signal while confirming an the presence of the yarn 2. However, if the yarn 2 is broken between the yarn package 8 and the yarn guide 10, the sensor issues a stop signal to automatically stop the loom while detecting the breakage of the yarn, whereby the loom is automatically stopped. After stopping of the loom, remaining yarn is subjected to disposal by a device, for example a device as disclosed in U.S. Ser. No. 903,816, filed Sep. 6, 1986 and now U.S. Pat. No. 4,756,341 and European Patent Application No. 86112239.8, at the side of the measuring and storing device and the picking device. The yarn guide device 1, after disposal of the yarn 2, starts a sequential operation necessary to pull out a yarn from a new package 8 as shown in imaginary line or two dotted lines.

Figure 2:
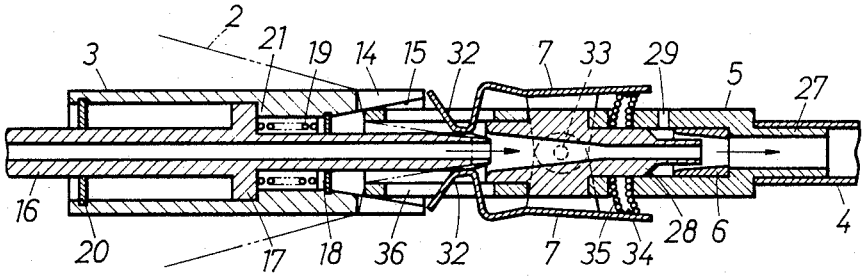
FIGS. 2 to 4 are cross sectional views illustrating various operations of the yarn guide device of FIG. 1.
Figure 5:
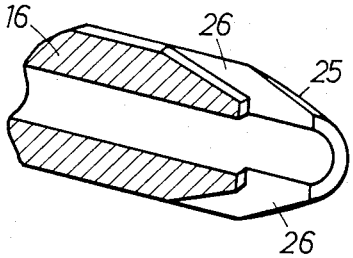
FIG. 5 is a perspective fragmentary view of a tip end of an inserter of the yarn guide device of FIG. 1.

The guide tube 4 is moved in the direction of the arrow shown in FIG. 1 from a retracted position by an air cylinder or a winding unit such as a belt and a chain, to thereby cause the engaging member 5 to pass through the larger hole of the yarn guide 10 and move toward the guide member 3. With the movement of the engaging member 5, the pair of clamping memebers 7 are moved away from the cams 37 so that the clamping members are closed at the end thereof while biased by the coil spring 35. The engaging member 5 is inserted inside the tapered hole 15 of the guide member 3 as shown in FIG. 2, and moved along the inner surface of the guide member. The engaging member 5 is inserted until it is engaged satisfactorily with the tapered inner surface of the guide member because of elasticity of the guide tube 4. With the engagement of the engaging member 5 and the guide member 3, the guide member 3 and the engaging member 5 are coaxially arranged with each other, and a relative positional relation between the pair of holding members and the guide member 3 is determined. After completion of the engagement, the engaging member 5 moves forward or advances while causing the guide member 3 to be retracted against the resiliency of the spring 19. While the guide member 3 is retracted, the pair of clamping members 7 move forward and hit the tapered surface 25 of the inserter 16, and are opened at the tip end thereof. While the guide member 3 is retracted, the yarn 2 kept in the holding slit 14 is inserted into the slit 26 of the inserter 16, and guided to the portion adjacent to the opening of the needle 28. A part of the slit 26 of the inserter 16 is covered by the holding tongue 32 of the clamping members 7, but the slit 26 is not covered at the root thereof since the slit 26 extends axially for a distance, as shown in FIG. 5. The yarn 2 inserted by the inserter 16 under the holding tongue 32 is not restricted by the holding tongue, but is in a free state. In this state, the closing valves 23, 31 are opened to generate air flow in a direction to insert the yarn from the inside of the inserter 16 toward the hole of the needle 28, and at the same time generate air flow by the nozzle 6 in the direction to insert the yarn toward the inside of the guide tube. With the generation of the air flows, the cutter at the side where the yarn is broken is actuated to cut off the yarn 2 between the guide member 3 and the clamper 9. Thereafter, the tip end of the yarn 2 is drawn into the inside of the guide tube 4 with the air flow via the inside of the needle 28 and the inside of the nozzle 6. At this time, inasmuch as the guide member 3 and the engaging member 5 are connected with each other, the air flow is not likely to be turbulent, so that the yarn 2 is transferred from the guide member 3 to the guide tube 4 with certainty.

Figure 3:
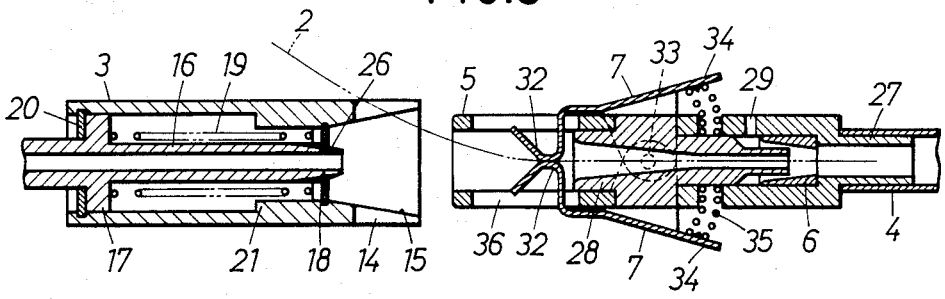
Figure 4:
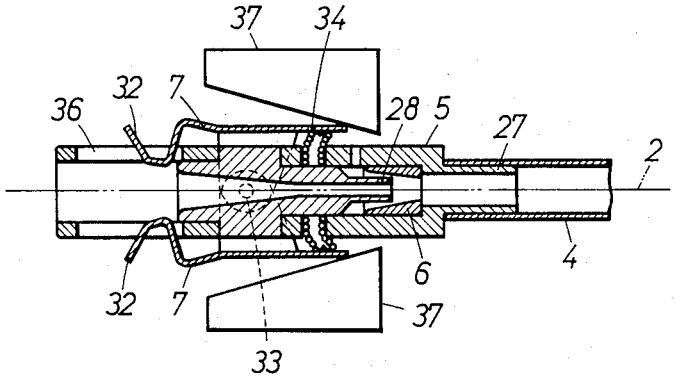

As shown in FIG. 3, the guide tube 4 is retracted with the engaging member 5 by the feeding device. During retraction of the engaging member 5, the pair of clamping members 7 are moved away from the tapered surface of the inserter 16, and urged by the coil spring 35 to approach each other to clamp mechanically the yarn 2 extending from the guide member 3 to the guide tube 4 with the holding tongues 32. Thereafter, the closing valves 23, 31 are closed to stop the air flow from the nozzle 6 and the inserter 16. The closing motion of the closing valves 23, 31 may be effected just before the retraction of the engaging member 5. The guide tube 4 and the engaging member 5 are returned to the original waiting position as shown in FIG. 4. At this time, the rear end pieces 34 of the pair of clamping members 7 again hit the cams 37 to cause the holding members to be opened so that the yarn 2 is free from the clamping members 7 and drawn by the guide tube 4. That is, at the state in FIG. 4 where the the air under pressure is supplied again from the port 29 to the nozzle 6, the yarn passes inside of the guide tube 4 with the air flow and is guided to the inside of the rotative yarn guide 10 provided at the side of a measuring and storing device.

After completion of the series of operations mentioned above, preliminary winding on the measuring and storing device and the insertion of yarn into the picking nozzle, the loom is ready to start. The series of operations is sequentially effected by a sequencer, which monitors the completion of each step of the operation. This is applicable to other embodiments described hereafter.

The air flow in the inserter 16 may be generated as a secondary air flow caused by suction, like the nozzle 6. Although the nozzle 6 is provided at the guide tube 4, it may alternatively be provided at the guide member 3. With this arrangement of the nozzle 6, the air flow can be transferred from the nozzle 6 to the inside of the guide tube 4 until the yarn 2 reaches the measuring and storing device while the guide member 3 and the engaging member 5 of the guide tube 4 are connected with each other.

SECOND EMBODIMENT

Figure 6:
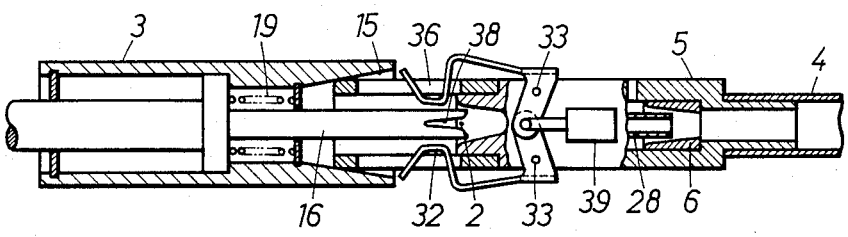
FIGS. 6 to 8 are cross sectional fragmentary views of a yarn guide device of a second embodiment according to the present invention.
Figure 7:
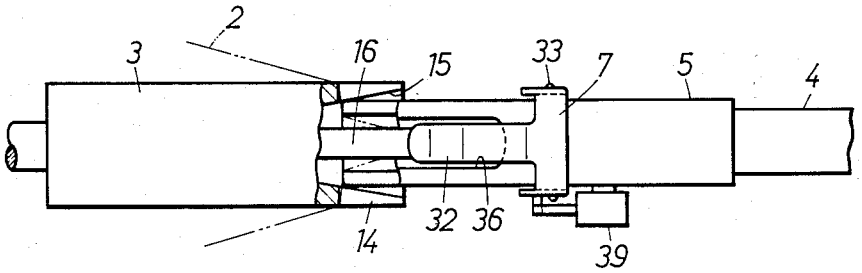
Figure 8:
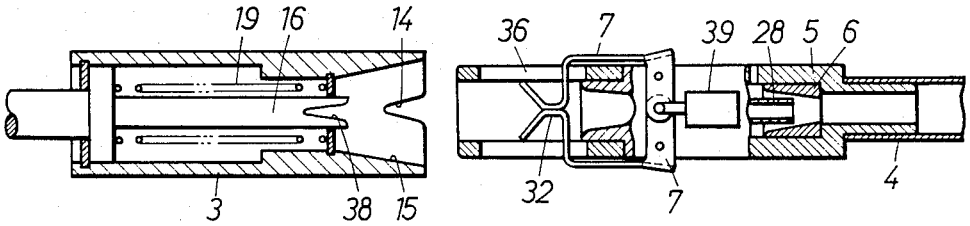

A second embodiment of the present invention is described with reference to FIGS. 6 to 8.

The tip end of the inserter 16 is not decreasingly tapered here, but provided with a V-shaped groove 38, and the closing motion of the holding members 7 is controlled by a cylinder 39. The V-shaped groove 38 is defined to be directed in the same direction as the holding groove 14 of the guide member 3, and the yarn 2 is positioned inside the holding groove 14 at the first stage of operation. A cylinder 39 is provided at the side of the engaging means 5 and moved with the engaging member 5 to cause the pair of clamping members 7 to open at the advanced position and to close at the time of retraction to hold the yarn 2 between the clamping members 7. At the retracted position, the clamping members release the yarn 2, which is then drawn into the inside of the guide tube 4 and guided to the predetermined position. Inasmuch as no air flow is generated from the inserter 16 in the second embodiment, the yarn 2 is drawn only by the secondary air flow generated by the nozzle 6 at the side of the engaging member 5.

THIRD EMBODIMENT

Figure 9:
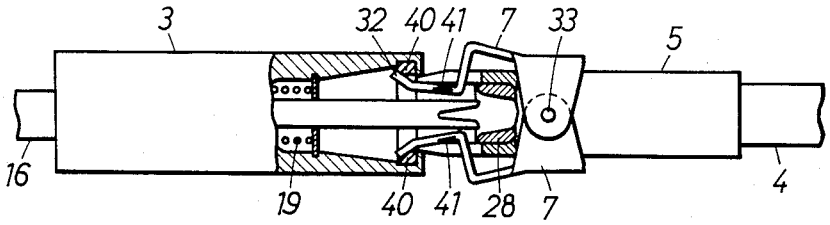
FIGS. 9 to 11 are views illustrating various operations of a yarn guide device of a third embodiment according to the present invention.
Figure 10:
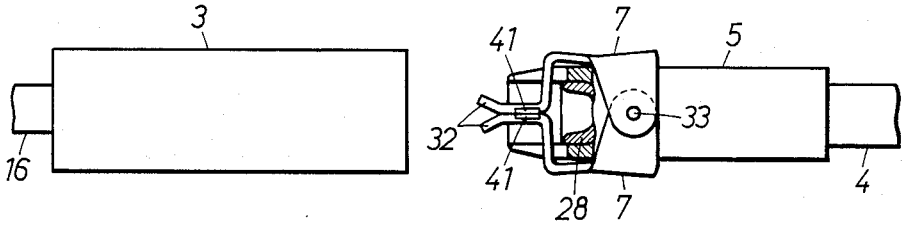
Figure 11:
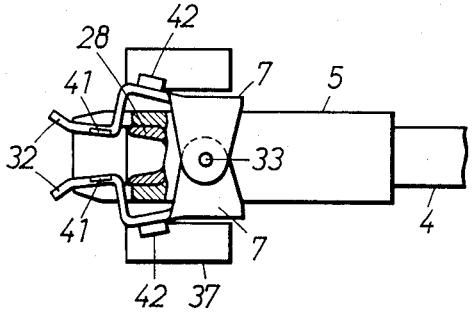

A third embodiment of the present invention will be described with reference to FIGS. 9 to 11.

Closing motion of a pair of clamping members 7, according to the third embodiment, is effected by permanent magnets 40, 41, 42. Magnetic force of the permanent magnet 42 is greater than that of the permanent magnet 41. The permanent magnet 40 provided at the guide member 3 attracts the tip ends of the clamping members 7 to open the tip ends when the engaging member 5 moves toward the guide member 3. When the engaging member 5 is moved backward or retracted, the permanent magnets 41 provided opposite each other at inner surfaces of the holding tongue 32 attract each other to close the clamping members 7 to clamp the yarn 2. The force to clamp the yarn 2 is increased by intervening rubber or a like material having a greater frictional coefficient at the clamping surfaces of the holding tongues 32. The clamping members are released from their holding state in the manner that the clamping members are attracted by the pemanent magnets 42 provided at the cams 37, and the yarn 2 is drawn by the suction nozzle provided at the engaging member 5 via the needle 28.

FOURTH EMBODIMENT

Figure 12:
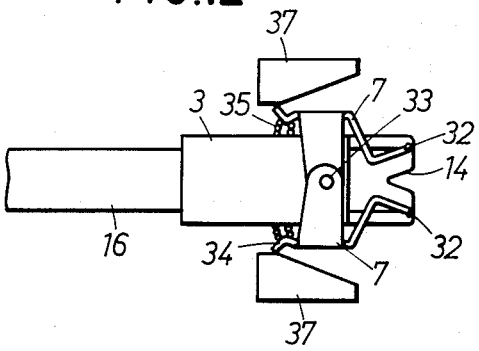
FIGS. 12 to 13 are views illustrating various operations of a yarn guide device of a fourth embodiment according to the present invention.
Figure 13:
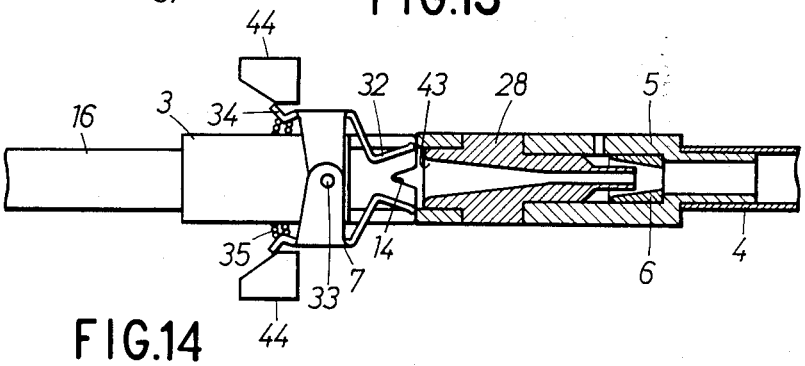

A fourth embodiment of the present invention will be described with reference to FIGS. 12 and 13.

The guide member 3 is movable toward and away from the fixed guide tube 4 according to the fourth embodiment which is different from the first three embodiments.

A pair of clamping members 7 are provided at both sides of the movable guide member 3 and the cams 37 are provided at a position adjacent to a retracted position of the guide member 3 where the cams 37 hit the rear end piece 34 of the clamping members 7, to open the holding tongues 32. When the guide member 3 is moved forward or advanced to hit the tapered end surface 43 of the engaging member 5 the pair of clamping members 7 hit the slant surfaces of a pair of cams 44 to open the holding tongues 32 and release the yarn 2.

FIFTH EMBODIMENT

Figure 14:
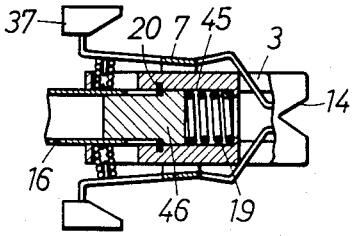
FIGS. 14 to 15 are cross sectional views of a yarn guide device of a fifth embodiment according to the present invention.
Figure 15:
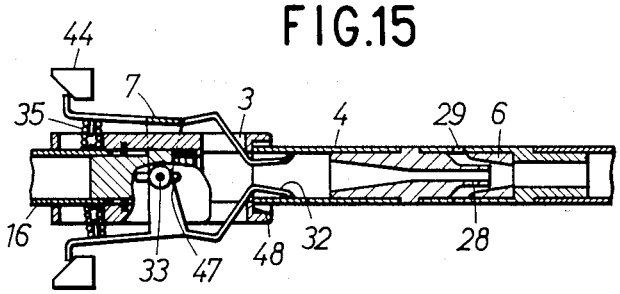

A fifth embodiment of the present invention will be described with reference to FIGS. 14 and 15.

The guide tube 4 is fixed, as in the fourth embodiment. The engaging member 5 is omitted, according to the fifth embodiment, as is evident from the comparison with the third embodiment of FIG. 10. The guide member 3 defines a cylinder 45 in which a slider 46 fixed to the inserter 16 is housed. The slider 46 is urged by a spring 19 in the direction to retract from the bottom portion of the cylinder 45, and the retraction limit is determined by a tail stopper 20. Two supporting pins 33 for a pair of clamping members 7 are fixed to the slider 46 through an elongate slit 47. The pair of clamping members 7 release, at a waiting position, the yarn 2, while striding over the yarn 2, held by the holding groove 14. Upon the advancement of the guide member 3, the pair of clamping members 7 are allowed to close by the cams 37 to hold the yarn. Upon further advancement of the guide member 3, an end surface 48 contacts the end surface of the guide tube 4, the slider 46 slides inside the cylinder 45 of the guide tube 3 against the urging force of the spring 19 with the movement of the inserter 16, and at the same time the clamping members 7 are inserted into the guide tube 4. At this time, inasmuch as the clamping members 7 release the yarn due to a cam 44, the yarn 2 is drawn into the guide tube 4 by the suction force of the nozzle 6. According to the fifth embodiment, inasmuch as the yarn 2 is sealed by the complete connection of the guide member 3 and the engaging member 5, and then the yarn 2 is released by the clamping members 7, there is such an advantage that the yarn 2 is drawn into the guide tube 4 more easily than in the fourth embodiment.

As is evident from the first five embodiments, the guide member 3 and the guide tube 4 may move to a position to pass the yarn to each other, hence any of or both of the guide member 3 and the guide tube 4 can move.

SIXTH EMBODIMENT

Figure 16:
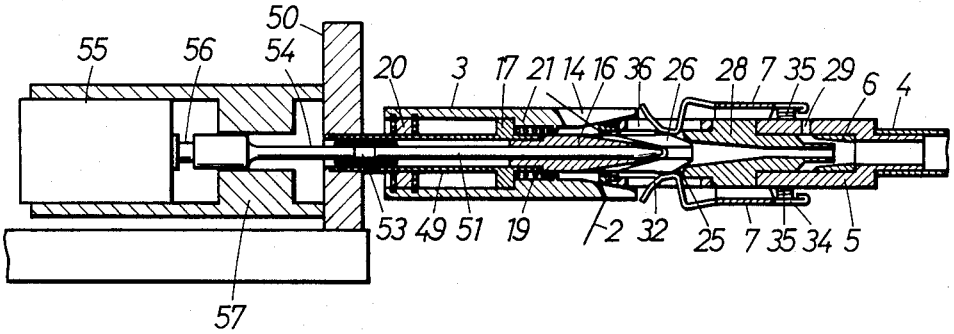
FIGS. 16 to 18 are cross sectional views of a yarn guide device of a sixth embodiment according to the present invention.
Figure 17:
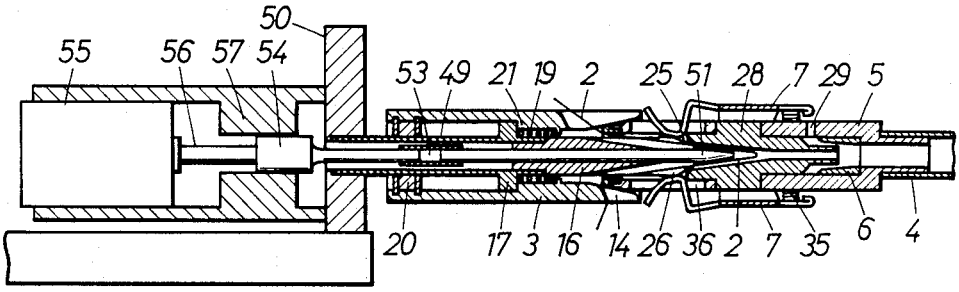
Figure 18:
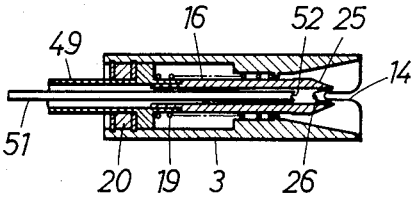

A sixth embodiment of the present invention will be described with reference to FIGS. 16 to 18.

The yarn 2 is transferred positively to the engaging member 5 by the forward or backward movement of an auxiliary inserter 51 without the use of air flow in the inserter 16. The inserter 16 has a rear end fixed to a tip end of a cylindrical holder 49. The holder 49 has a rear end fixed to a bracket 50 and inserted into the cylindrical guide member 3. The inserter 16 and the holder 49 retain therein the auxiliary inserter 51 in a retractable state. The auxiliary inserter 51 has a tip end provided with a holding groove 52 and a rear end connected with a piston rod 56 of an air cylinder 55 via a flexible coupling 53 such as a coil spring, and a connecting rod 54. The air cylinder 55 is fixed to a side surface of the bracket 50 by a guide member 57 for guiding the connecting rod 54.

The engaging member 5 is substantially the same as that in the first embodiment as shown in FIG. 1.

When the guide tube 4 is moved to the advanced limit, the air under pressure is introduced from the port 29 and simultaneously the piston rod 56 of the air cylinder 55 is forwardly moved by the air cylinder 55 to thereby cause the tip end of the auxiliary inserter 51 to move toward a throat of the tapered portion of the needle 28. With the movement of the arrangement, the yarn 2 is engaged by the slit 26 of the inserter 16 and, being in a positioning state, is engaged by a holding groove 52 of the auxiliary inserter 51 with certainty, as shown in FIG. 17, whereby the yarn 2 is released into the slit 26, inserted from the suction port of the needle 28 and reaches the throat of the tapered portion of the needle 28. Inasmuch as the air under pressure is introduced into the air inlet port 29 the air flow in the direction for drawing yarn is generated inside the guide tube 4, and at the same time the air flow in the direction for drawing yarn is generated inside the needle 28 due to the suction in the restriction portion of the needle 28. A speed of the air flow under suction in the throat of the needle is greater than that in the suction port, and the yarn 2 is exposed to the air under suction for a longer length so that the yarn 2 with the high air stream is moved away from the holding groove 52 of the auxiliary inserter 51, passes inside the needle 28, and reaches the inside of the guide tube 4 with ease.

SEVENTH EMBODIMENT

A seventh embodiment of the present invention will be described with reference to FIG. 19.

Figure 19:
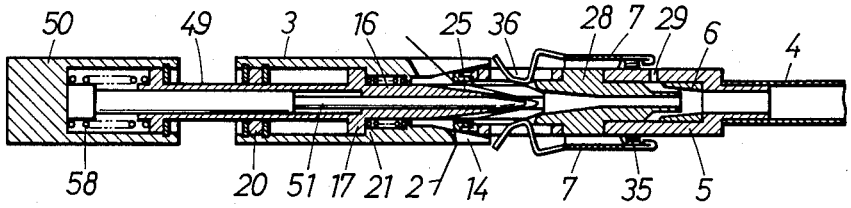
FIG. 19 is a cross sectional view of a yarn guide device of a seventh embodiment according to the present invention.

Although the yarn guide device in the sixth embodiment has the inserter 16 fixed to the bracket 50 by the holder 49 and the auxiliary inserter 14 is movable by the air cylinder 55, the forward movement of the auxiliary inserter 14 can be achieved by utilizing the retractable movement of the guide tube 4 as shown in FIG. 19.

According to the seventh embodiment, the auxiliary inserter 51 is fixed to the bracket 50 and the inserter 16 is integrated with the holder 49, so that the inserter 16 and the holder 49 are slidable relative to the auxiliary inserter 51 through the tail stopper 20, which guides and is slidable over the holder 49. The engaging member 5 hits the guide member 3, then retracts the guide member against the resiliency of the spring 19. Thereafter, inasmuch as the step 21 hits the stopper 17 and then moves further forward against the resiliency of the coil spring 58, the fixed auxiliary inserter 51 moves in the forward direction relative to the inserter 16 to thereby guide the yarn 2 to the inside of the needle 28.

EIGHTH EMBODIMENT

Figure 20:
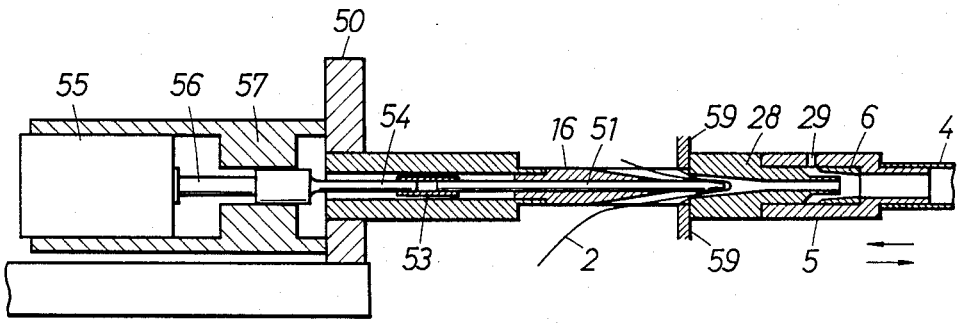
FIG. 20 is a cross sectional view of a yarn guide device of an eighth embodiment according to the present invention.

An eighth embodiment of the present invention will be described with reference to FIG. 20.

Although the yarn guide device 1 according to the first to eighth embodiments are provided between the yarn package and the measuring and storing device of the weft yarn for achieving the object mentioned above, the yarn guide device is provided not only for achieving the object of the present invention mentioned above, but also for being employed for yarn insertion to a heald and a reed.

According to the eighth embodiment, the inserter 16 and the guide tube 4 are disposed opposite each other with the heald 59 intervening therebetween. When the guide tube 4 is moved forward utmost in the direction of the heald 59, the auxiliary inserter 51 passes the hole of the heald 59 to thereby guide the yarn 2 to the restriction portion of the nozzle 6 at the same time, inasmuch as the air under pressure is introduced from the air inlet port 29 to generate air flow in the direction for drawing the yarn, and weft insertion is carried out.

Although the invention has been described in preferred form with a certain degree of particularity, it is to be understood that many variations and changes are possible in the invention without departing from the scope thereof.

What is claimed is:

1. A yarn guide device, comprising:

a yarn guide means for positioning and holding yarn;

a yarn guide tube means for receiving and guiding yarn from said yarn guide means at a yarn receiving position, said yarn guide tube means comprising a yarn guide tube;

at least one of said yarn guide means and said yarn guide tube means being reciprocable relative to the other of said yarn guide means and said yarn guide tube means, said yarn guide means comprising a hollow yarn guide member;

a yarn inserter means for transferring yarn from said yarn guide means to said yarn guide tube means, said yarn inserter means comprising a yarn inserter member disposed inside of said yarn guide member, said yarn inserter member being movable relative to said yarn guide member to transfer yarn from said yarn guide means into said yarn guide tube means; and at least one of said yarn guide means and said yarn guide tube means having a nozzle means for generating an air flow to assist transfer of yarn to said yarn guide tube means.

2. The yarn guide device as set forth in claim 1, wherein:

said nozzle means comprises a cylindrical nozzle insert in said yarn guide tube member.

3. The yarn guide device as set forth in claim 2, wherein:

said yarn inserter member has a tapered tip end, said yarn inserter member having a slit for holding yarn at said tapered tip end.

4. The yarn guide device as set forth in claim 1, wherein:

said yarn inserter member has a tapered tip end, said yarn inserter member having a slit for holding yarn at said tapered tip end.

5. The yarn device as set forth in claim 1, wherein:

said yarn inserter member is hollow, said yarn inserter member having disposed therein an auxiliary inserter member, said auxiliary inserter member reciprocably movable relative to said yarn inserter member to assist in the transfer of yarn to said yarn guide tube means.

6. The yarn guide device as set forth in claim 5, and further comprising:

means for moving said auxiliary inserter member relative to said yarn inserter member.

7. The yarn guide device as set forth in claim 5, and further comprising:

means for biasing said yarn inserter member relative to said auxiliary inserter member in the direction of said yarn guide tube means, said means for biasing comprising a coil spring.

8. The yarn guide device as set forth in claim 1, wherein:

said hollow yarn guide member comprises a cylindrical portion disposed opposite said yarn guide tube, the longitudinal axis of said cylindrical portion extending in the direction of yarn transfer when yarn is transferred from said yarn guide means to said yarn guide tube means, said cylindrical portion having a yarn holding groove for holding yarn to be transferred.

9. A yarn guide device, comprising:

a yarn guide means for positioning and holding yarn;

a yarn guide tube means for receiving and guiding yarn from said yarn guide means at a yarn receiving position, said yarn guide tube means comprising a yarn guide tube;

at least one of said yarn guide means and said yarn guide tube means being movable relative to the other of said yarn guide means and said yarn guide tube means to transfer yarn from said yarn guide means to said yarn guide tube means;

at least one of said yarn guide means and said yarn guide tube means having a nozzle means for generating an air flow to assist transfer of yarn from said yarn guide means to said yarn guide tube means; and clamping means provided on one of said yarn guide means and said yarn guide tube means for clamping said yarn during transfer of yarn from said yarn guide means to said yarn guide tube means and subsequently releasing said yarn from clamping to complete transfer of yarn from said yarn guide means to said yarn guide tube means.

10. The yarn guide device as set forth in claim 9, wherein:

said clamping means comprises an pair of clamping members, spring means for biasing said clamping members toward a closed, clamping position, and cam members positioned so as to engage and cam said clamping members toward an open, yarn-releasing position.

11. The yarn guide device as set forth in claim 9, wherein:

said clamping means comprises a pair of clamping members and a plunger means for moving said clamping members between a closed yarn clamping position and an open yarn releasing position.

12. The yarn guide device as set forth in claim 9, wherein:

said clamping means comprises a pair clamping members, a first pair of permanent magnets, each said clamping member having one magnet of said first pair of permanent magnets to attract said clamping member toward the other said clamping member toward a closed yarn clamping position, and a second pair of permanent magnets, each magnet of said second pair of permanent magnets disposed so as to attract a respective clamping member toward an opened yarn releasing position, said second pair of permanent magnets having an attractive force with respect to said pair of clamping members sufficient to overcome the attractive force between said first pair of permanent magnets.

13. The yarn guide device as set forth in claim 9, wherein:

said yarn guide means comprises a cylindrical portion disposed opposite said yarn guide tube, the longitudinal axis of said cylindrical portion extending in the direction of yarn transfer when yarn is transferred from said yarn guide means to said yarn guide tube means, said cylindrical portion having a yarn holding groove for holding yarn to be transferred.

14. The yarn guide device as set forth in claim 9, wherein:

said clamping means comprises a pair of clamping members pivotably connected to said yarn guide tube means.

15. The yarn guide device as set forth in claim 14, wherein:

said yarn guide means comprises a hollow yarn guide member, said yarn guide member having a slot for holding yarn to be transferred to said yarn guide means;

each said clamping member comprises a tongue member, both said tongue members together enabling said pair of clamping members to be pried open;

a yarn inserter member is slidably disposed in said hollow yarn guide member, said yarn inserter member having a tapered tip end and a slit at said tapered tip end for holding yarn;

whereby sliding movement of said yarn inserter member relative to said hollow yarn guide member causes said slit of said yarn inserter member to take yarn from said slot of said hollow yarn guide member and said tapered tip end of said yarn inserter member to contact said tongue members to pry open said pair of clamping members on said yarn guide tube means, enabling transfer of yarn to said yarn guide tube.

16. A yarn guide device, comprising:

a yarn guide means for positioning and holding yarn;

a yarn guide tube means for receiving and guiding yarn from said yarn guide means, said yarn guide tube means comprising a yarn guide tube, and said yarn guide tube means reciprocably movable from a yarn drawing position to a yarn receiving position at said yarn guide means for receiving and drawing yarn from said yarn guide means into said yarn guide tube;

said yarn guide means comprising a hollow yarn guide member;

a yarn inserter means for transferring yarn from said yarn guide means to said yarn guide tube means, said yarn inserter means comprising a yarn inserter member slidably disposed in said hollow yarn guide member, said yarn inserter member slidable relative to said yarn guide member to transfer yarn from said yarn guide means into said yarn guide tube;

at least one of said yarn guide means and said yarn guide tube means having a nozzle means for generating an air flow to assist transfer of yarn to said yarn guide tube means;

said yarn guide tube having an inlet portion for receiving yarn from said yarn guide means; and clamping means provided at said inlet portion of said yarn guide tube for clamping said yarn during transfer of yarn form said yarn guide means to said yarn guide tube and releasing said yarn when said yarn guide tube means has returned to said yarn drawing position.

* * * * *